US007828073B2

(12) United States Patent
Liebert et al.

(10) Patent No.: US 7,828,073 B2
(45) Date of Patent: Nov. 9, 2010

(54) VIBRATING HAND-HELD POWER TOOL WITH A LOCKING SWITCH FOR A MOTOR SWITCH

(75) Inventors: Bernhard Liebert, Pfaffenhofen a. d. Glonn (DE); Pierre Pallmer, Igling (DE)

(73) Assignee: Hilti Aktiengesellschaft, Schaan (LI)

( * ) Notice: Subject to any disclaimer, the term of this patent is extended or adjusted under 35 U.S.C. 154(b) by 108 days.

(21) Appl. No.: 12/215,631

(22) Filed: Jun. 27, 2008

(65) Prior Publication Data

US 2009/0008111 A1 Jan. 8, 2009

(30) Foreign Application Priority Data

Jul. 2, 2007 (DE) ..... 10 2007 000 362

(51) Int. Cl.
*B25D 17/00* (2006.01)

(52) U.S. Cl. ..... 173/171; 173/162.1; 173/162.2

(58) Field of Classification Search ..... 173/48, 173/171, 217, 162.1, 162.2
See application file for complete search history.

(56) References Cited

U.S. PATENT DOCUMENTS 6,466,868 B2 * 10/2002 Sakashita ..... 701/211
6,550,545 B1 * 4/2003 Manschitz et al. ..... 173/48
2003/0226673 A1 * 12/2003 Burger et al. ..... 173/48

* cited by examiner

*Primary Examiner*—Thanh K Truong
*Assistant Examiner*—Nathaniel Chukwurah
(74) *Attorney, Agent, or Firm*—Abelman, Frayne & Schwab

(57) ABSTRACT

A rotary-percussion hand-held power tool includes a vibrating percussion mechanism (2) for applying blows along a percussion axis (A), a guiding handle (4) vibrationally decoupled from the percussion mechanism (2) and provided with a motor switch (5) displaceable in switching region (X) for blocking the motor switch (5), an operational mode selection switch (3) arranged in the percussion mechanism (2), and a switching bar (9) displaceable by the operational mode selection switch (3) and having a stop (10) that projects into the switching region (X) of the locking switch (7) in the drilling operational mode.

4 Claims, 2 Drawing Sheets

VIBRATING HAND-HELD POWER TOOL WITH A LOCKING SWITCH FOR A MOTOR SWITCH

BACKGROUND OF THE INVENTION

1. Field of the Invention

The present invention relates to a rotary-percussion power tool such as a combination hammer with a locking switch for blocking the motor switch during a chisel operation.

2. Description of the Prior Art

In the hand-held power tools which apply blows along a percussion axis and rotate thereabout, the guiding handle is vibrationally decoupled from the percussion mechanism. For a pure percussion operation, usually, the motor switch that controls the operation of the power tool motor, is blocked in its switch-on condition by a locking switch. However, this is not the case for the further drilling or rotating mode.

German Publication DE 10 034 768 discloses an electrical combination hammer drill in which the guiding handle is vibrationally decoupled with respect to the percussion mechanism. The locking switch for the motor switch is formed as a catch bracket located (at a correct handling of the power tool) in the lower handle stirrup and is hingedly supported in several points. The locking switch is connected with a rotatable operational mode selection switch. Such a solution is technologically expensive and limits the free space in the lower stirrup.

According to German Publication DE 199 37 767, a hand-held power tool which vibrates along a percussion axis, has a guiding handle provided with a motor switch and a locking switch located (at a correct handling of the power tool) on the upper handle stirrup. The locking switch blocks the motor switch in the motor switch complete switch-on condition. The blocking action of the locking switch is controlled by a displaceable rigid bar connectable with a rotatable operational mode selection switch of the percussion mechanism by an eccentric disc. The switching bar insures that blocking is possible only in the chisel operational mode but not in the drilling operational mode. This solution is likewise rather complicated.

Accordingly, an object of the present invention is a vibrating hand-held power tool provided with means that insures a technologically simple control of the locking switch for the motor switch in the vibrationally decoupled guiding handle.

SUMMARY OF THE INVENTION

This and other objects of the present invention, which will become apparent hereinafter are achieved by providing a rotary-percussion hand-held power tool including a vibrating percussion mechanism for applying blows along a percussion axis, a guiding handle vibrationally decoupled from the percussion mechanism, a motor switch provided on the guiding handle for controlling a power tool, and a locking switch associated with the motor switch and displaceable in a switching region for blocking the same. The power tool further includes an operational mode selection switch arranged in the percussion mechanism for switching an operation of the switching mechanism between a drilling operational mode and a chisel operational mode, and a switching bar displaceable by the operational mode selection switch.

The control of the blocking function with a loose stop, not connected with the locking switch, permits to realize a fatigue-free and technologically simple blocking of the motor switch even with a guiding handle that is vibrationally decoupled from the percussion mechanism.

Advantageously, for blocking the motor switch, there is provided a flexible elastic leaf spring deformable by the locking switch upon its displacement. The leaf spring has one of its ends fixedly secured and another of its ends formed as a hook formlockingly engageable in an associated recess provided on the motor switch. Thereby, a robust and technologically simple blocking of the motor switch is insured.

Advantageously, the leaf spring is located (at a correct handling of the power tool) in the upper handle stirrup. Thereby, the free space in the lower handle stirrup remains available for other structural groups.

Advantageously, the locking switch is formed as a slide manually displaceable in an axial direction and, preferably, located on the upper surface of the upper handle stirrup. Thereby with a grasped guiding handle, the slide is ergonomically displaceable with a thumb.

Advantageously, the leaf spring forms within its axial extension, a nose oriented toward the locking switch-forming slide along which the axially displaceable slide at least partially slides. The slide, engages the nose of the spring, pressing the hook, which is provided at the free end of the spring, into the recess of the motor switch in the motor-switch switch-on condition.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
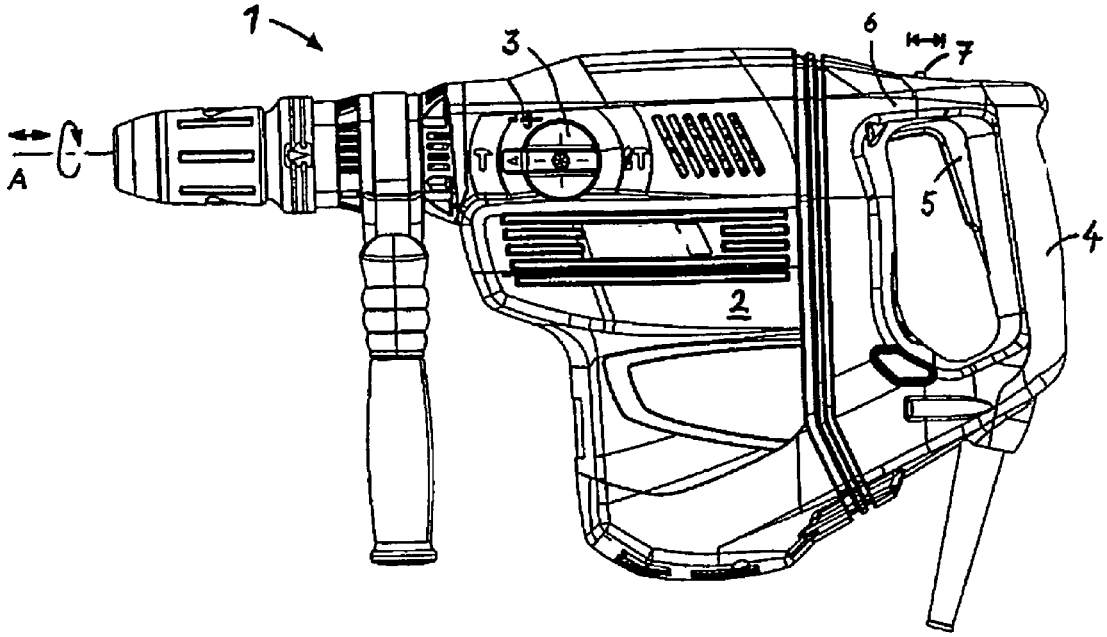
FIG. 1 a side view of a hand-held power tool according to the present invention.

A rotary-percussion hand-held power tool 1, which is shown in FIG. 1 and is formed as a combination hammer, has a percussion mechanism 2 for applying blows along a percussion axis A and including an operational mode selection switch 3 pivotable between a rotary-percussion drilling operational mode and only percussion chisel operational mode, and a guiding handle 4 that is vibrationally decoupled from the percussion mechanism 2. In the guiding handle 4, there is arranged a motor switch 5 for controlling the power tool motor and which is locked in its switch-on position by a locking switch 7 formed as an axially longitudinally displaceable slide and located on an upper side of an upper stirrup 6 of the handle 4.

Figure 2:
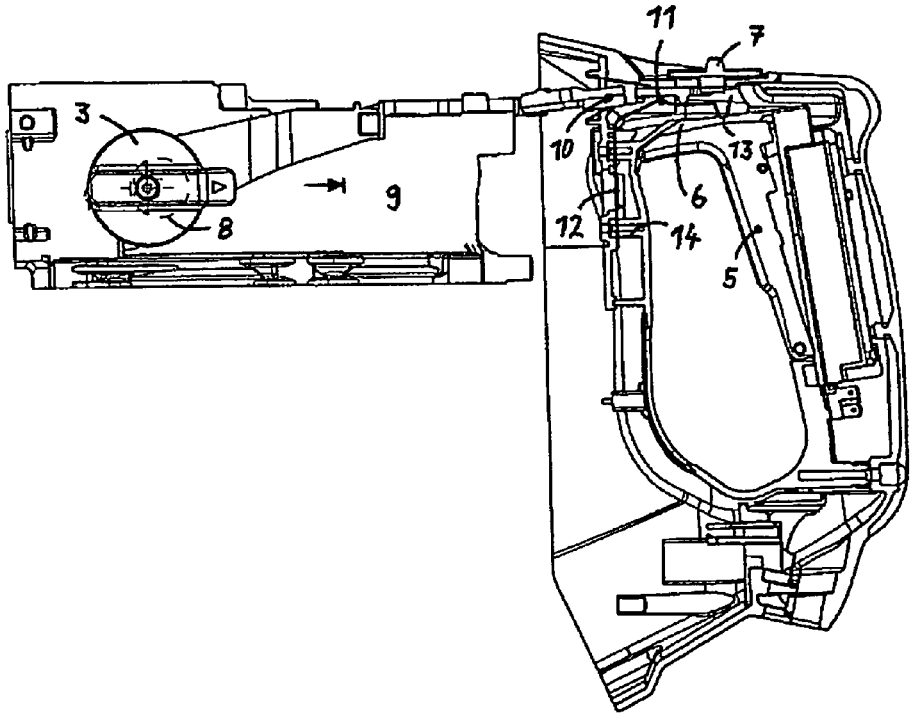
FIG. 2 a side view of a section of the power tool shown in FIG. 1.
Figure 3:
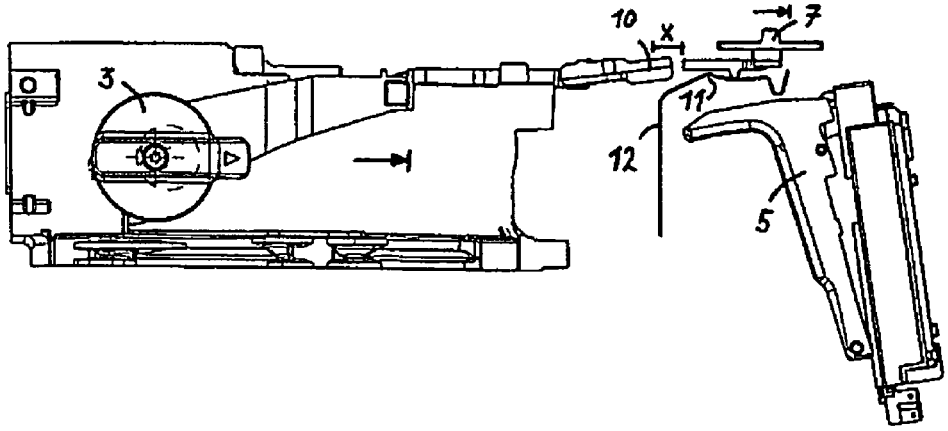
FIG. 3 a side view of a detail of the power tool section shown in FIG. 2 during operation of the power tool in a drilling operational mode.

As shown in FIGS. 2 and 3, a switching bar 9 is axially displaced toward the guiding handle 4 by an eccentric disc 8 in response to the operational mode selection switch 3 being switched to its drilling operational mode. As a result of the handle-side displacement of the switching bar 9, a stop 10 projects in a switching region of the locking switch 7. Thereby, the locking switch 7 is not displaced sufficiently far in the direction of the percussion mechanism 2 to block the motor switch 5, i.e., not sufficiently far to actuate a nose 11 of a flexible leaf spring 12. The nose 11 extends axially in the upper handle stirrup 6, forms at its free end, a hook 13, and has its other end connected with a handle structural group 14.

Figure 4:
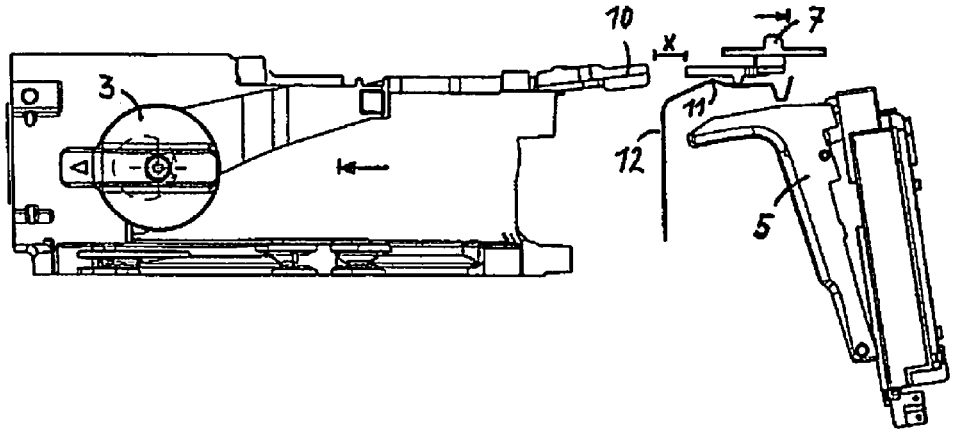
FIG. 4 a side view of a detail of the power tool section shown in FIG. 2 during operation of the power tool in a chisel operational mode.

As shown in FIG. 4, the switching bar 9 is displaced axially in the direction of the percussion mechanism 2 in response to the operational mode selection switch 3 being switched to its chisel operational mode. As a result, the stop 10 does not project any more into the switching region of the locking switch 7 so that the locking switch 7 can be displaced sufficiently far in the direction of the percussion mechanism 2 for blocking the motor switch 5 by actuating the nose 11 of the leaf spring 12.

Figure 5:
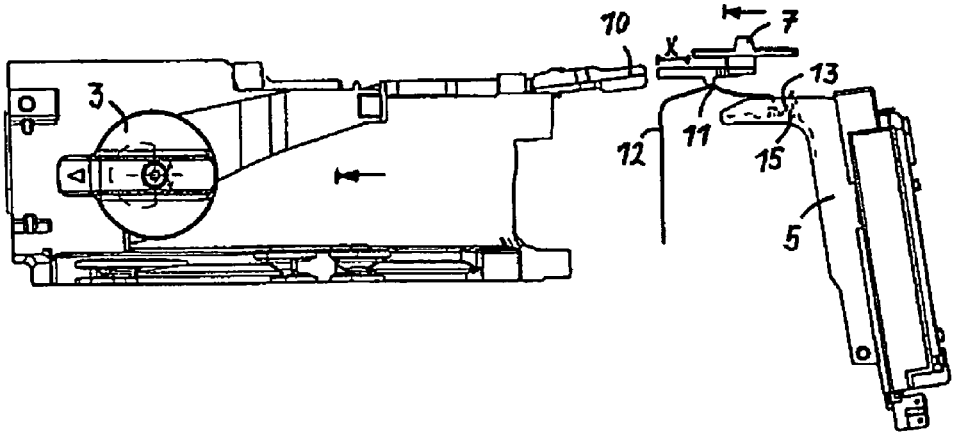
FIG. 5 a side view of a detail of the power tool section shown in FIG. 2 in a motor switch-blocking chisel operational mode.

As shown in FIG. 5, the switching bar 9 is displaced axially in the direction of the percussion mechanism 2 in response to the operational mode selection switch 3 being switched to its chisel operational mode. As a result, the stop 10 does not project any more into the switching region of the locking switch 7. The locking switch 7 is displaced in the direction of the percussion mechanism 2 for blocking the motor switch 5, actuating the nose 11 of the leaf spring 12 and elastically deforming the nose 11. As a result of the deformation of the nose 11, the hook 13, which is provided on the free end of the nose 11, formlockingly engages in a recess 15 of the actuated motor switch 5, blocking the motor switch 5 in its switch-on position.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A rotary-percussion hand-held power tool, comprising a vibrating percussion mechanism (2) for applying blows along a percussion axis (A); a guiding handle (4) vibrationally decoupled from the percussion mechanism (2); a motor switch (5) provided on the guiding handle (4) for controlling a power tool motor; a locking switch (7) associated with the motor switch (5) and displaceable in switching region (X) for blocking same; an operational mode selection switch (3) arranged in the percussion mechanism (2) for switching an operation of the percussion mechanism (2) between a drilling operational mode and a chisel operational mode; a switching bar (9) displaceable by the operational mode selection switch (3) and having a stop (10) that projects into the switching region (X) of the locking switch (7) upon switching of the mode selection switch (3) to the drilling operational mode to prevent the locking switch (7) from blocking the motor switch (5) in the drilling operational mode; and means for blocking the motor switch (5) in a switch-on position thereof and actuatable by the locking switch (7) in the chisel operational mode, the blocking means comprising a flexible elastic leaf spring (12) deformable by the locking switch (7) upon displacement thereof and having one end fixedly secured and forming, at another end thereof, a hook (13) formlockingly engageable in an associated recess (14) provided on the motor switch (5).

2. A hand-held power tool according to claim 1, wherein the leaf spring (12) is located in an upper handle stirrup (6).

3. A hand-held power tool according to claim 1, wherein the locking switch (7) is formed as a slide manually displaceable in an axial direction.

4. A hand-held power tool according to claim 3, wherein the leaf spring (12) forms, within an axial extension thereof, a nose (11) oriented toward the locking switch-forming slide and over which the axially displaceable slide at least partially slides.

* * * * *